US008998370B2

(12) United States Patent
Studer et al.

(10) Patent No.: US 8,998,370 B2
(45) Date of Patent: Apr. 7, 2015

(54) WEB-FED PRINTER CONFIGURATION

(71) Applicant: Hewlett-Packard Development Company, L.P., Houston, TX (US)

(72) Inventors: Anthony D. Studer, Albany, OR (US); Karsten N. Wilson, Eugene, OR (US); Ross E. Friesen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

(21) Appl. No.: 13/847,302

(22) Filed: Mar. 19, 2013

(65) Prior Publication Data

US 2014/0285559 A1 Sep. 25, 2014

(51) Int. Cl.

| | |
|---|---|
| ***B41J 29/38*** | (2006.01) |
| ***B41J 3/60*** | (2006.01) |
| ***B41J 15/16*** | (2006.01) |

(52) U.S. Cl.
CPC . *B41J 3/60* (2013.01); *B41J 15/165* (2013.01)

(58) Field of Classification Search
None
See application file for complete search history.

(56) References Cited

U.S. PATENT DOCUMENTS

| | | | |
|---|---|---|---|
| 6,641,314 | B2 | 11/2003 | Mogi |
| 7,665,817 | B2 | 2/2010 | Folkins |
| 7,774,085 | B2 | 8/2010 | Yang |
| 2009/0016797 | A1 | 1/2009 | Brugue et al. |
| 2009/0136281 | A1 | 5/2009 | Fernandez et al. |

*Primary Examiner* — Justin Seo
(74) *Attorney, Agent, or Firm* — Dicke, Billig & Czaja, PLLC

(57) ABSTRACT

A process of configuring a web-fed printer is disclosed. Parameters for a web of printable media used in the web-fed printer and for print density are received. The parameters are applied to determine tension of the printable media and speed of the printable media through a print engine of the web-fed printer.

20 Claims, 3 Drawing Sheets

WEB-FED PRINTER CONFIGURATION

BACKGROUND

Web-fed printing devices are commonplace and can be found, for example, in industrial or retail printing environments. Web-fed refers to the webs, or rolls, of media, being fed into the printing devices and are distinguishable from sheet-fed printers. Sheet-fed refers to individual sheets of media being fed into the printing device. The media can include paper, polymeric materials, or other media adapted for printing. Sheet-fed printing devices offer the advantages of being configurable for different format sizes and waste sheets can be reused for testing, which can lead to flexibility and lower cost print preparation. Web-fed printing devices, however, provide much faster printing than sheet-fed devices. The speed of web-fed printing devices makes them ideal for large runs such as newspapers, magazines, and books.

Web-fed printing devices can be used for offset, or analog, printing or for digital printing. Offset printing is a commonly used printing technique in which the inked image is transferred, or offset, from a plate to a rubber blanket, then to the printing surface. When used in combination with the lithographic process, which is based on the repulsion of oil and water, the offset technique employs a flat, or planographic, image carrier on which the image to be printed obtains ink from ink rollers while the non-printing area attracts a water-based film, or fountain solution, to keep the non-printing areas free from ink. Digital printing refers to methods of printing from a digital based image directly to the media. Digital printing can refer to professional printing where print jobs from desktop publishing and other digital sources are printed using large format or high volume laser or inkjet printers. In some circumstances, digital printing has a higher cost per page than more traditional offset printing, but the price is usually offset by the cost saving in avoiding steps to make printing plates. It also can more easily provide for on demand printing, short turn around, and even a modification of the image (variable data) with each impression.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
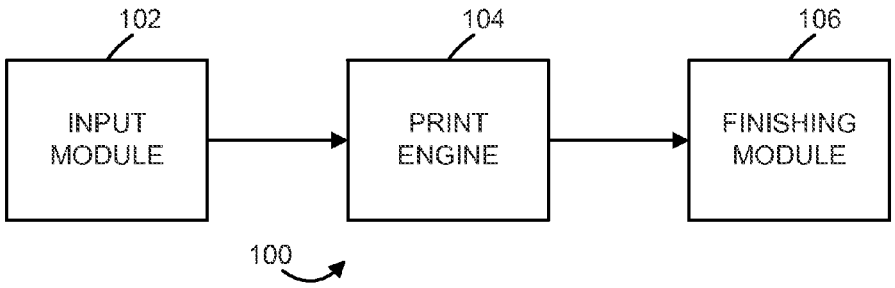
FIG. 1 is a block diagram illustrating an example architecture of a printing device.

FIG. 1 illustrates an example architecture of a printing device, such as a web-fed printing device 100. The web-fed printing device 100 includes an input module 102 to carry a roll of printable media. The input module 102 provides the media to a print engine 104 to print and dry the media. In some examples, the print engine provides for double-sided, or duplex, printing and can use ink-jet printing carriages. The printing device 100 often includes a finishing module 106 to cut, collate, staple, or otherwise finish the printing process. Often, the modules are interchangeable, and different modules from different manufacturers can be combined as desired to provide a particular printing solution for a printer.

Stand alone finishing modules, such as finishing module 106, are made to industry standards and are typically offered by third parties. Consequently, these finishing modules typically are not integrated with print engine 104 and operate via slack loop, i.e., where the media is fed to finishing module 106 without tension from print engine 104, or almost completely open loop. Generally, finishing module 106 is just set in place and aligned with the print engine 104. In a typical example, a dancer loop of the media in finishing module 106 is used to signal the finishing module to speed up or slow down based on the speed of the media fed from print engine 104. Additionally, print engine 104 provides start and stop signals to control the finishing module 106. Typically, finishing module 106 can operate at much higher speeds than the capabilities of print engine 104. In order to perform efficiently, finishing modules 106 receive the printed media from the print engine 104 in a form that is dry, stable, and flat with minimal distortion from media cockle and wrinkles. Accordingly, typical print engines 104 include closed loop controlled print zones for each side of the media, high-powered dryers, and active web steering mechanisms that continuously sense the position of the web and mechanically interact with the steering rollers to steer a web to a predetermined position.

Figure 2:
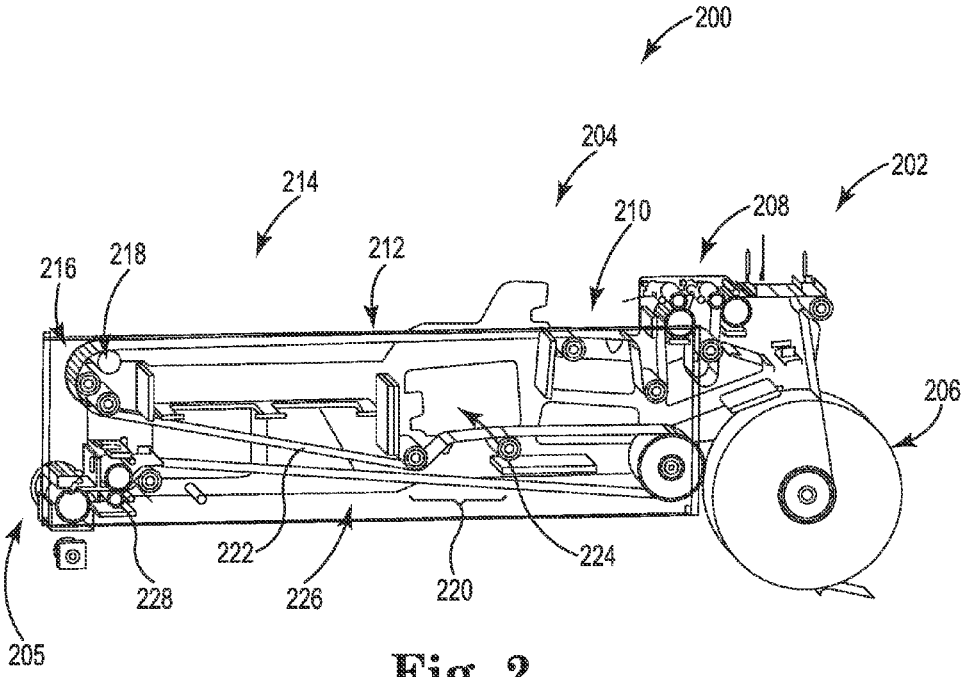
FIG. 2 is a schematic diagram illustrating an example printing device constructed in accordance with the example architecture of FIG. 1.

FIG. 2 illustrates a web-fed printing device 200 constructed in accordance with the architecture 100 but having integrated together a media input 202 close coupled with a print engine 204 that is close coupled to a finishing module 106 such as an integrated sheeter 205 a finisher (not shown). The close coupling provides for direct coupling of the print engine 204 to media input 202 and sheeter 205 without the use of buffers such as dancer loops and slack web. Media input 202 accepts a web of printable media 206, which is fed through a first set of rollers 208 to an upper print zone 210. Upper print zone 210 can accept print cartridges (not shown) to print on the first side 212 of media 206. A first passive drying region 214 is distal the upper print zone 210 and includes a region where the media 206 is fed around a second set of rollers 216. In one example, the second set of rollers 216 includes a load cell roller 218, which is used to adjust tension of the media against the other rollers. The load cell roller 218 in some examples provides temporary tension during configuration and, in other examples, can be removed from the web-fed printing device prior to printing. The media 206 is fed through a third set of rollers 220 that presents the second side 222 of media 206 to a lower print zone 224, which also can accept print cartridges (not shown). A second passive drying region 226 is distal to the lower print zone 224. The media 206 is directly provided to the sheeter 205 at an outfeed nip drive roller 228.

Web-fed printing device 200 provides for passive steering and passive drying, which eliminates expensive corresponding components found in other web-fed printing devices. Passive steering implementations use a balance of forces to restrict the media to a predetermined path. Active steering devices, in contrast, continuously sense the position of the media and mechanically interact with the steering rollers to steer a web to a predetermined position. Active steering uses a mechanism to adjust the angle at which the media enters and leaves the roller that will adjust how the media moves along the axis of the roller. Active steering mechanisms may be expensive to build, add size and weight to the printer, difficult to implement without introducing aberrations into the print image, and complicated to control. Printers without passive drying, such as air-drying, employ high powered heaters and fans to dry the printing, which also adds costs to the printer and its use.

Print speed of the web-fed printing device 200 is affected by several factors, including print density, the physical length of the first and second drying regions 214, 226, respectively, the tension in the first and second print zones 210, 224, respectively, and the type of media 206 and printer ink (in the printer cartridges) being used. For any given combination of these factors, the optimum speed of the print engine 204 may not be the optimum speed of the sheeter 205.

Figure 3:
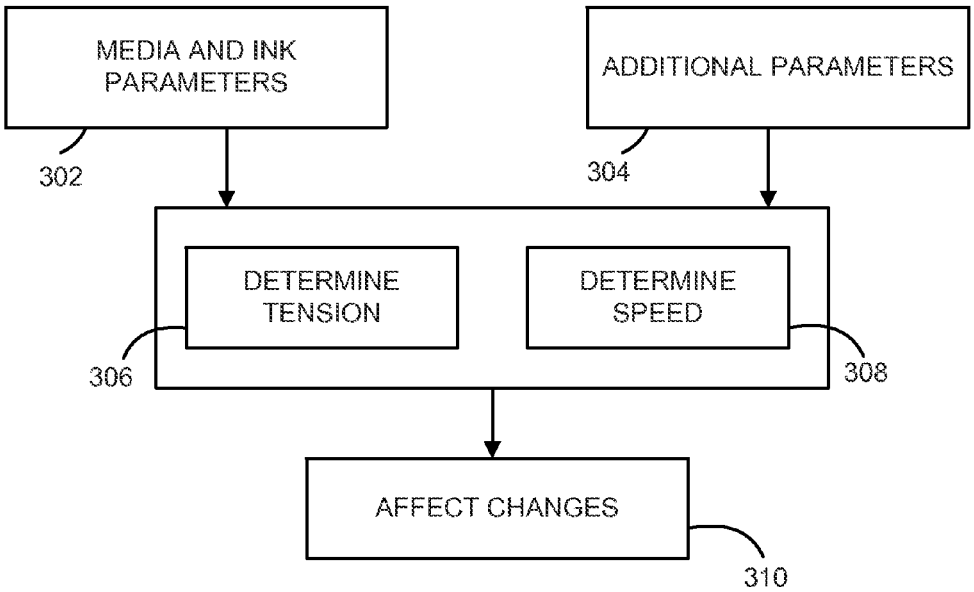
FIG. 3 is a flow diagram illustrating an example process for setting parameters of the example printing device of FIG. 2.

FIG. 3 illustrates a process 300 to select a beneficial tension in the print zones and speed of a web-fed printing device such as web-fed printing device 200. Parameters of media 206 and parameters of the ink used for printing are input at 302. In one example, an operator can enter the parameters of the media 206 whenever changing a load or ink. Media parameters can include features such as type, thickness, and basis weight of the media 206, media roll hardness, media roll moisture content, or other variables or measurable features of the media 206. Ink parameters can include such features as ink type or other parameters. In another example, sensors disposed within a web-fed printing device can be used to determine the parameters. Other variable parameters can include whether the printing will be all graphics, all text, or various combinations of graphics and text. Generally, a beneficial speed for graphics is slower than that for text. Additional parameters can be considered to determine media tension and speed at 304, such as maximum print density and variable print density for each print job, where print density relates to the lightness or darkness of the image. For example, the maximum print density for the device may be fixed or based on a variable preferred density contingent on the type of printing performed for a particular print job or media type.

The inputs 302 and 304 are applied and used to determine a beneficial tension of the media at 306. The inputs 302 and 304, and other factors such as the maximum speed of the print engine 204 and the maximum speed of the sheeter 205 or finisher are used as limiting factors to determine a beneficial print speed at 308. In the example, the physical length of the media stretched through the print engine 204 is used to determine the amount of passive drying applied to the media 206 after printing. In other examples, where the lengths are variable or the environmental conditions affect the passive drying, the lengths of the media and sensed environmental conditions, such as temperature and humidity, can be applied to determine tension 306 or speed 308.

The determined tension 306 and speed 308 are affected at 310. For example, the tension can be adjusted via the outfeed nip drive roller 228 distal to the second print zone 224. Speed can be adjusted through adjusting the number of rotations per unit time of rollers connected to a drive mechanism (not shown).

In one example, the beneficial tension 306 and speed 308 are determined through applying the parameters to look up tables. It should be noted that the amount of optimization could be dependent on the amount of characterization of the printing device performed to create the look up tables. If the operator of the printing device desires a wide variety of media 206, print densities, or ink and the overall speed of the printing device varies by a substantial amount, more characterization of the printing device may be performed. In one example where each printing device can be used to program or add characterizations to the look-up tables, the load cell roller 218 can be used to help characterize tensions in the print zones 210 and 224. The load cell roller 218 can then be left idle or removed for operation of the printing device.

Figure 4:
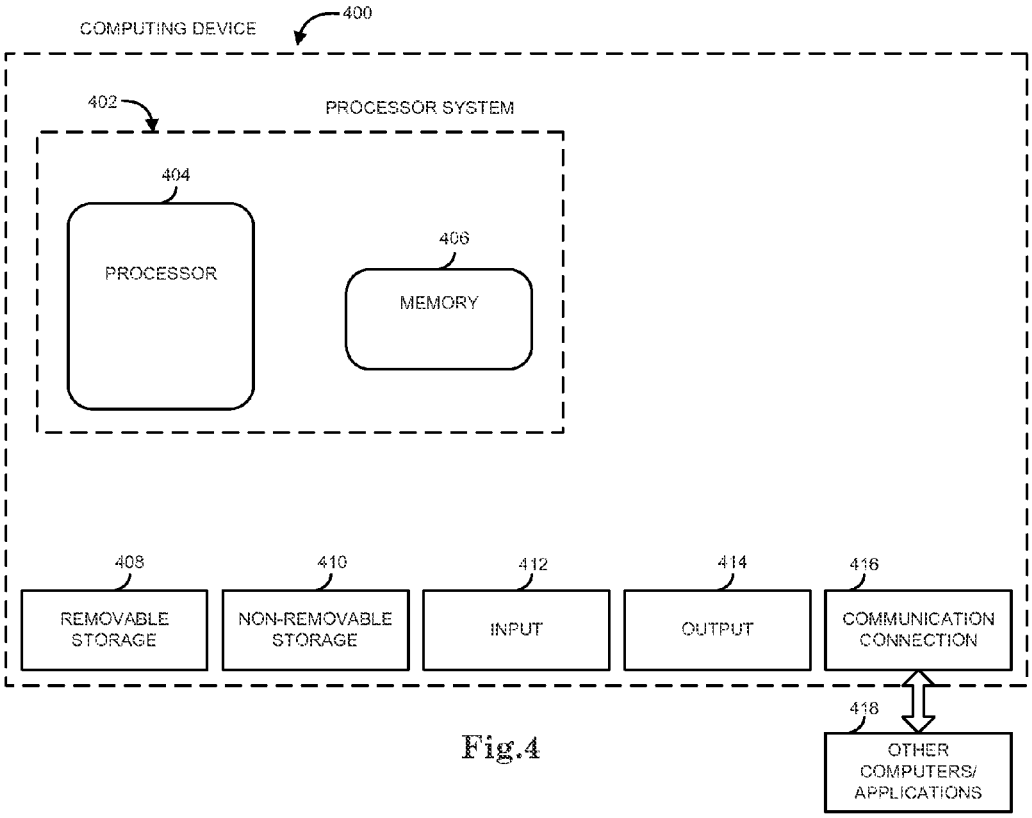
FIG. 4 is a schematic diagram of an example computing device to perform the example process of FIG. 3.

FIG. 4 illustrates an exemplary computer system that can be employed in an operating environment and used to host or run a computer application included on a computer readable storage medium storing computer executable instructions for controlling the system, such as a printing device, to perform process 300. The computer system can also be used to develop and/or store additional characterizations to the look up tables that are stored in a computer readable storage medium.

The exemplary computer system includes a computing device, such as computing device 400. In a basic hardware configuration, computing device 400 typically includes a processor system having a processing unit, i.e., processors 402, and memory 404. By way of example, the processing units may include, but are not limited to, two or more processing cores on a chip or two or more processor chips. In some examples, the computing device can also have additional processing or specialized processors (not shown), such as a graphics processor for general-purpose computing on graphics processor units, to perform processing functions offloaded from the processor 402. The memory 404 may be arranged in a hierarchy and may include cache memory. Depending on the configuration and type of computing device, memory 404 may be volatile (such as random access memory (RAM)), non-volatile (such as read only memory (ROM), flash memory, etc.), or some combination of the two. Example computing devices 400 can take several forms. Such forms include a tablet, a personal computer, a workstation, a server, a handheld device, a consumer electronic device (such as a video game console), or other, and can be a stand-alone device or as part of a computer network, computer cluster, cloud services infrastructure, or other.

Computing device 400 can also have additional features or functionality. For example, computing device 400 may also include additional storage. Such storage may be removable and/or non-removable and can include, but is not limited to, magnetic or optical disks or solid-state memory, or flash storage devices such as removable storage 408 and non-removable storage 410. Computer storage media includes volatile and nonvolatile, removable and non-removable media implemented in any suitable method or technology for storage of information such as computer readable instructions, data structures, program modules or other data. Memory 404, removable storage 408 and non-removable storage 410 are all examples of computer storage media. Computer storage media includes, but is not limited to, RAM, ROM, EEPROM, flash memory or other memory technology, CD-ROM, digital versatile discs (DVD) or other optical storage, magnetic cassettes, magnetic tape, magnetic disk storage or other magnetic storage devices, universal serial bus (USB) flash drive, flash memory card, or other flash storage devices, or any other storage medium that can be used to store the desired information and that can be accessed by computing device 400. Any such computer storage media may be part of computing device 400.

Computing device 400 often includes input and/or output connections, such as USB connections, display ports, proprietary connections, and others to connect to various devices to provide inputs and outputs to the computing device. Input devices 412 may include devices such as keyboard, pointing device (e.g., mouse), pen, voice input device, touch input device, or other. Output devices 411 may include devices such as a display, speakers, printer, or the like.

Computing device 400 often includes communication connections 414 that allow computing device 400 to communicate with other computers/applications 415. Example communication connections can include, but are not limited to, an Ethernet interface, a wireless interface, a bus interface, a storage area network interface, and a proprietary interface. The communication connections can be used to couple the computing device 400 to a computer network, which can be classified according to a wide variety of characteristics such as topology, connection method, and scale. A network is a collection of computing devices and possibly other devices interconnected by communications channels that facilitate communications and allows sharing of resources and information among interconnected devices. Examples of computer networks include a local area network, a wide area network, the Internet, or other network.

Computing device 400 can run an operating system software program and computer applications, which make up a system platform. A computer application to execute on the computing device 400 includes at least one process (or task), which is an executing program. Each process provides the resources to execute the program. Threads run in the context of the process. A thread is the basic unit to which an operating system allocates time in the processor 402. The thread is the entity within a process that can be scheduled for execution. Threads of a process can share its virtual address space and system resources. Each thread can include exception handlers, a scheduling priority, thread local storage, a thread identifier, and a thread context, or thread state, until the thread is scheduled. A thread context includes the thread's set of machine registers, the kernel stack, a thread environmental block, and a user stack in the address space of the process corresponding with the thread. Threads can communicate with each other during processing through techniques such as message passing.

An operation may execute in a thread separate from the main application thread. When an application calls methods to perform an operation, the application can continue executing on its thread while the method performs its task. Concurrent programming for shared-memory multiprocessors can include the ability for multiple threads to access the same data. The shared-memory model is the most commonly deployed method of multithread communication. Multiple threads execute on multiple processors, multiple processor cores, multiple logical nodes in a single processor core, and/or other classes of parallelism that are attached to a memory shared between the processors.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A web-fed printer, comprising:

a media input integrated with a print engine and a finishing module, wherein the print engine can receive a web of printable media from the media input;

the print engine comprising:

a first print zone to print on a first side of the printable media;

a second print zone to print on a second side of the printable media, wherein the printable media is fed from the first print zone to the second print zone through a first drying region;

a drive roller to output the printable media to the finishing module, wherein the printable media is fed from the second print zone to the drive roller through a second drying region; and a controller to receive parameters of the printable media and print density and to apply the parameters of the printable media and print density to determine tension of the printable media through the print engine, and to apply the parameters of the printable media and print density to determine speed of the printable media through the print engine.

2. The printer of claim 1 wherein the print engine is directly coupled to the media input and the finishing module.

3. The printer of claim 1 wherein the first and second drying region are passive drying regions.

4. The printer of claim 1 including a load cell roller to adjust tension of the printable media.

5. The printer of claim 4 wherein the load cell roller is removable prior to printing.

6. The printer of claim 5 wherein the load cell roller is included as part of a set of rollers in the first drying region.

7. The printer of claim 1 wherein the controller is to receive parameters of the ink used to print on the printable media.

8. The printer of claim 1 wherein the controller determines tension and speed of the printable media through applying the parameters of the printable media to a look up table.

9. The printer of claim 8 wherein the lookup table is programmed to include characterizations of the print engine.

10. The printer of claim 1 wherein the print engine includes passive steering of the printable media through the first and second print zones.

11. A process of configuring a web-fed printer, the process comprising:

receiving a first set of parameters for a web of printable media used in the web-fed printer;

receiving a second set of parameters for print density;

applying the first and second set of parameters to determine tension of the printable media through a print engine of the web-fed printer; and applying the first and second set of parameters to determine speed of the printable media through the print engine.

12. The process of claim 11 wherein the determined speed of the printable media is not greater than the lower of a maximum speed of the print engine and a maximum speed of a finishing module integrated to the print engine.

13. The process of claim 11 wherein the first set of parameters includes at least one of type of media, thickness of media, and basis weight of the printable media.

14. The process of claim 11 wherein the first set of parameters further includes type of ink used for printing to the printable media.

15. The process of claim 11 wherein one of the first and second set of parameters further includes physical length of passive drying zones in the web-fed printer.

16. The process of claim 11 wherein the first set of parameters is determined from sensors on the web-fed printer.

17. The process of claim 11 wherein the tension is determined through applying the first and second set of parameters to a lookup table.

18. A non-transitory computer-readable storage medium storing computer executable instructions for controlling a web-fed printer to perform a process, the process comprising:

receiving a first set of parameters for a web of printable media used in the web-fed printer;

receiving a second set of parameters for print density;

applying the first and second set of parameters to a look up table to determine tension of the printable media through a print engine of the web-fed printer; and applying the first and second set of parameters to determine speed of the printable media through the print engine.

19. The non-transitory computer-readable storage medium of claim 18 wherein the look up table is programmable to include further characterizations of the web-fed printer.

20. The non-transitory computer-readable storage medium of claim 18 wherein the web-fed printer includes passive drying regions.

* * * * *